United States Patent [19]

Knowlton et al.

[11] Patent Number: 4,527,642

[45] Date of Patent: Jul. 9, 1985

[54] EARTH-BORING DRILL BIT WITH RECTANGULAR NOZZLES

[75] Inventors: Ruth H. Knowlton; Hsin Huang, both of Salt Lake City, Utah

[73] Assignee: Norton Christensen, Inc., Salt Lake City, Utah

[21] Appl. No.: 420,794

[22] Filed: Sep. 21, 1982

[51] Int. Cl.[3] ..... E21B 10/46; E21B 10/60

[52] U.S. Cl. ..... 175/329; 175/393

[58] Field of Search ..... 175/329, 393

[56] References Cited

U.S. PATENT DOCUMENTS

| | | | |
|---|---|---|---|
| 2,119,349 | 5/1938 | Pearce | 175/393 |
| 3,310,126 | 3/1967 | Gstalder et al. | 175/329 |
| 3,709,308 | 1/1973 | Rowley | 175/329 |
| 3,727,704 | 4/1973 | Abplanalp | 175/329 |
| 4,244,432 | 1/1981 | Rowley | 175/329 |

*Primary Examiner*—William F. Pate, III

*Attorney, Agent, or Firm*—Beehler, Pavitt, Siegemund, Jagger & Martella

[57] ABSTRACT

Earth-boring drill bits with one or more substantially rectangular nozzles through which drilling fluid is discharged to clean and cool the bit cutters and flush the cuttings produced by the bit from the drilling region to the top of the bore hole. The rectangular nozzle is more effective in cleaning and cooling the cutters and in removing the cuttings, when compared with the results achieved with the nozzle having a round or circular bore. The rectangular nozzle has a larger cross-sectional area than a circular nozzle while providing substantially the same fluid pressure drop across the nozzle, larger particles in the drilling fluid being capable of passing through the rectangular nozzle which would plug the passage through the circular nozzle. More specifically, rectangular nozzles are highly effective when incorporated in polycrystalline diamond compact bits, in which various cutter arrangements can be used.

5 Claims, 14 Drawing Figures

FIG. 2
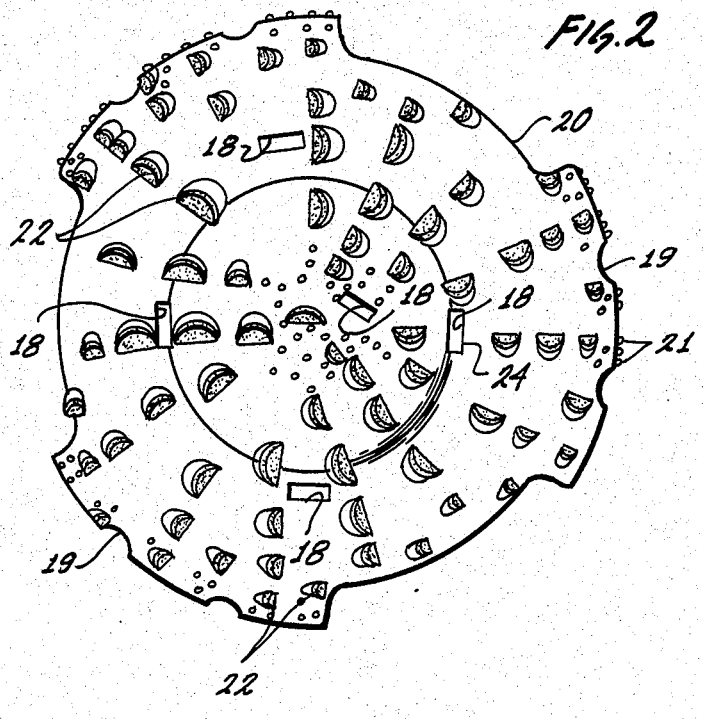
FIG. 5a
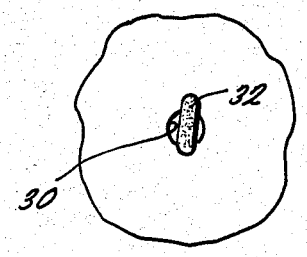
FIG. 5b
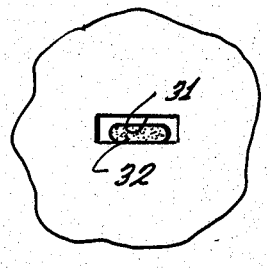
FIG. 9
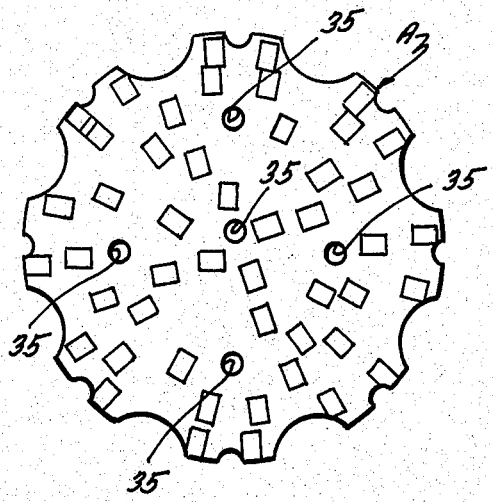
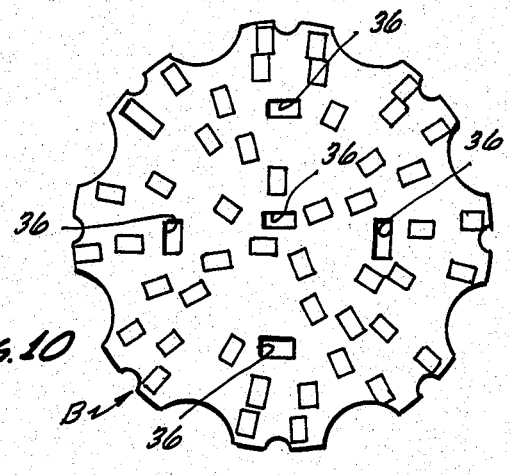
FIG. 10

EARTH-BORING DRILL BIT WITH RECTANGULAR NOZZLES

BACKGROUND OF THE INVENTION

Polycrystalline diamond compact drill bits are disclosed in U.S. Pat. No. 4,244,432, in which the synthetic diamond bits have their cutters arranged in many ways, including straight blades, spiral blades and uniformly distributed cutters. The bit crown, made of a hard material, such as metal bonded tungsten carbide, has profiles ranging from flat, for drilling soft to medium formations, to more steeply profiled bits for use in harder formations.

Regardless of the profile or cutter arrangement, there are common characteristics of all polycrystalline diamond compact bits. Cutting is done by a shearing action, which produces rock shavings that are considerably larger than those made by a conventional diamond bit. The fluid discharge nozzle portions of the bit are very close to the formation surface being cut and assist in the cutting action by eroding pieces of the rock beneath them. Efficient removal of the volume of cuttings produced prevents recutting of rock fragments, which reduces the stresses on the compact cutters.

It is commonly accepted that penetration rates of the bit in the formation are a function of hydraulic efficiency, as well as of the mechanical parameters, such as bit weight, rotational speed and rock strength. Because hydraulics are an integral of the drilling process, fluid mechanics must be given consideration in the design process as cutter placement density and orientation.

In order to clean the bit uniformly, polycrystalline diamond bits often have more than three nozzles. Bit size and cutter arrangement determine the number of nozzles and their orientation. The total flow area of the nozzles is determined by the hydraulic requirements found in the individual drilling situation. As the number of nozzles in the bit increases for a given total flow area, bit plugging becomes more of a problem because the orifice of the nozzle is smaller. With a round nozzle orifice, the cross-sectional area through the nozzle is relatively small, making it easier for debris to plug the nozzle orifice.

STATEMENT OF THE INVENTION

It has been found that a bit using one or more nozzles of rectangular cross-section enables its area to be made larger than the corresponding area of a nozzle of circular cross-section, the pressure drop across the nozzle of rectangular cross-section being substantially the same as the pressure drop through the nozzle of circular cross-sectional area.

The incorporation of the rectangular nozzles in polycrystalline diamond compact drill bits results in efficient removal of the cuttings produced by the cutters, thereby preventing the necessity for recutting formation fragments. Additionally, the rectangular nozzles enhances the cleaning action of the fluid discharging from the nozzles on the cutters, and more effectively causes the fluid to sweep across the face of the bit, to carry the formation cuttings toward and around the gauge portion of the bit for upward conveyance through the annulus surrounding the bit and the drill string connected thereto to the top of the bore hole. The features just referred to causes bits with the rectangular nozzles or orifices to out perform prior bits embodying round nozzles. Orientation of the rectangular nozzles with the long axis of each nozzle disposed in a tangential direction also results in an increased penetration rate of the bit.

This invention possesses many other advantages, and has other objects which may be made more clearly apparent from a consideration of the several forms in which it may be embodied. Such forms are shown in the drawings accompanying and forming part of the present specification. These forms will now be described in detail for the purpose of illustrating the general principles of the invention, but it is to be understood that such detailed description is not to be taken in a limiting sense.

Referring to the drawings:

FIG. 2 is plan view of the bottom of the bit taken on the line 2—2 of FIG. 1;

Figure 6:
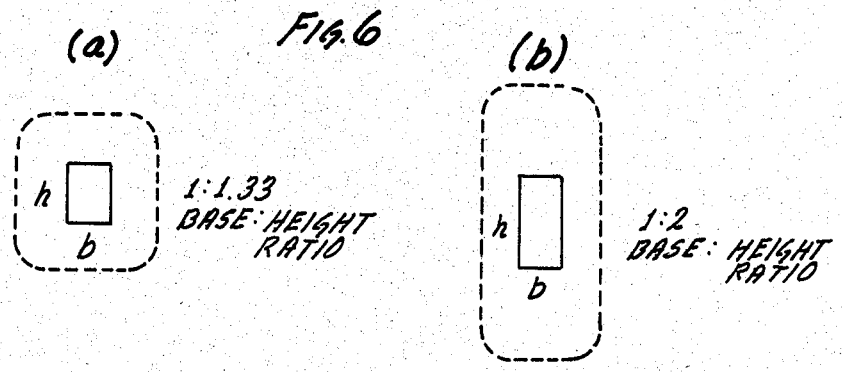

FIG. 5*a* is a diagrammatic view of a large particle plugging a round nozzle or orifice formed in the bit matrix;

FIG. 5*b* is a view similar to FIG. 5*a* disclosing a large particle passing through a nozzle or orifice or a rectangular shape;

FIGS. 6(*a*)(*b*) demonstrates the flow of vectors calculated in two rectangular ports or orifices of different geometries.

Figure 7:
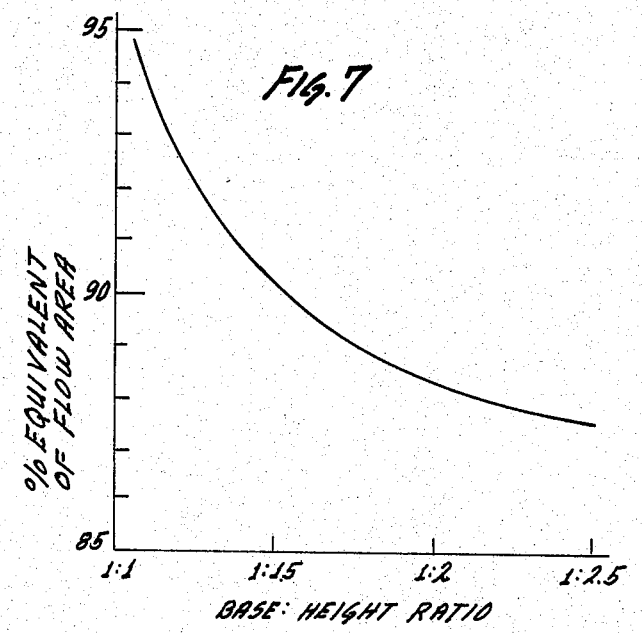
Figure 11:
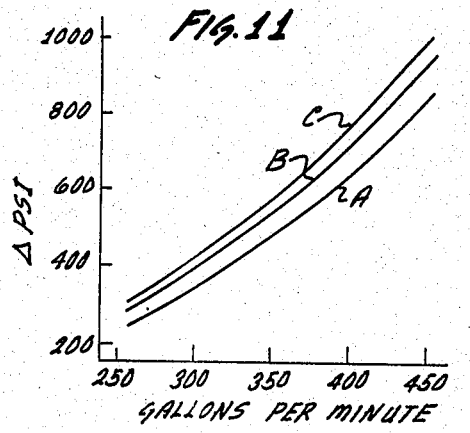
Figure 12:
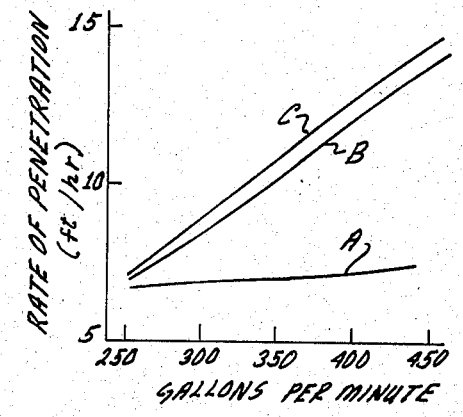
Figure 8:
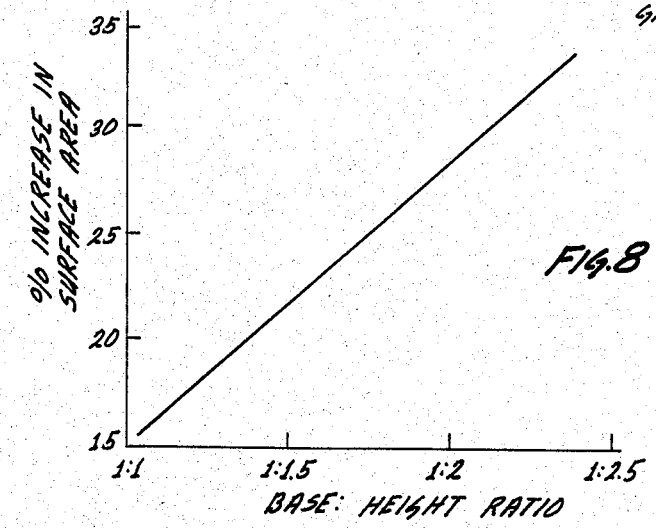

FIG. 7 is a graph showing the percent correction factor that relates the rectangular nozzle area to the equivalent round nozzle area in terms of pressure drop;

FIG. 8 is a graph showing the percent of increase in surface area of the rectangular nozzle or orifice over a round nozzle or orifice having the same equivalent flow area. As an example, the same 1.5 base/height ratio of the rectangular nozzle will yield a 21.5% increase in perimeter over a round nozzle having the same equivalent flow area;

FIG. 9 is a plan view of the bottom of the bit, corresponding to FIG. 2, of an actual bit having round nozzles used in drilling a bore hole;

FIG. 10 is a view corresponding to FIG. 9 of the same bit embodying rectangular nozzles manufactured and run in drilling the bore hole;

FIG. 11 graphically represents pressure drop trends in the bits disclosed in FIGS. 9 and 10; and FIG. 12 graphically compares penetration rates versus hydraulics of the bits shown in FIGS. 9 and 10.

Figure 1:
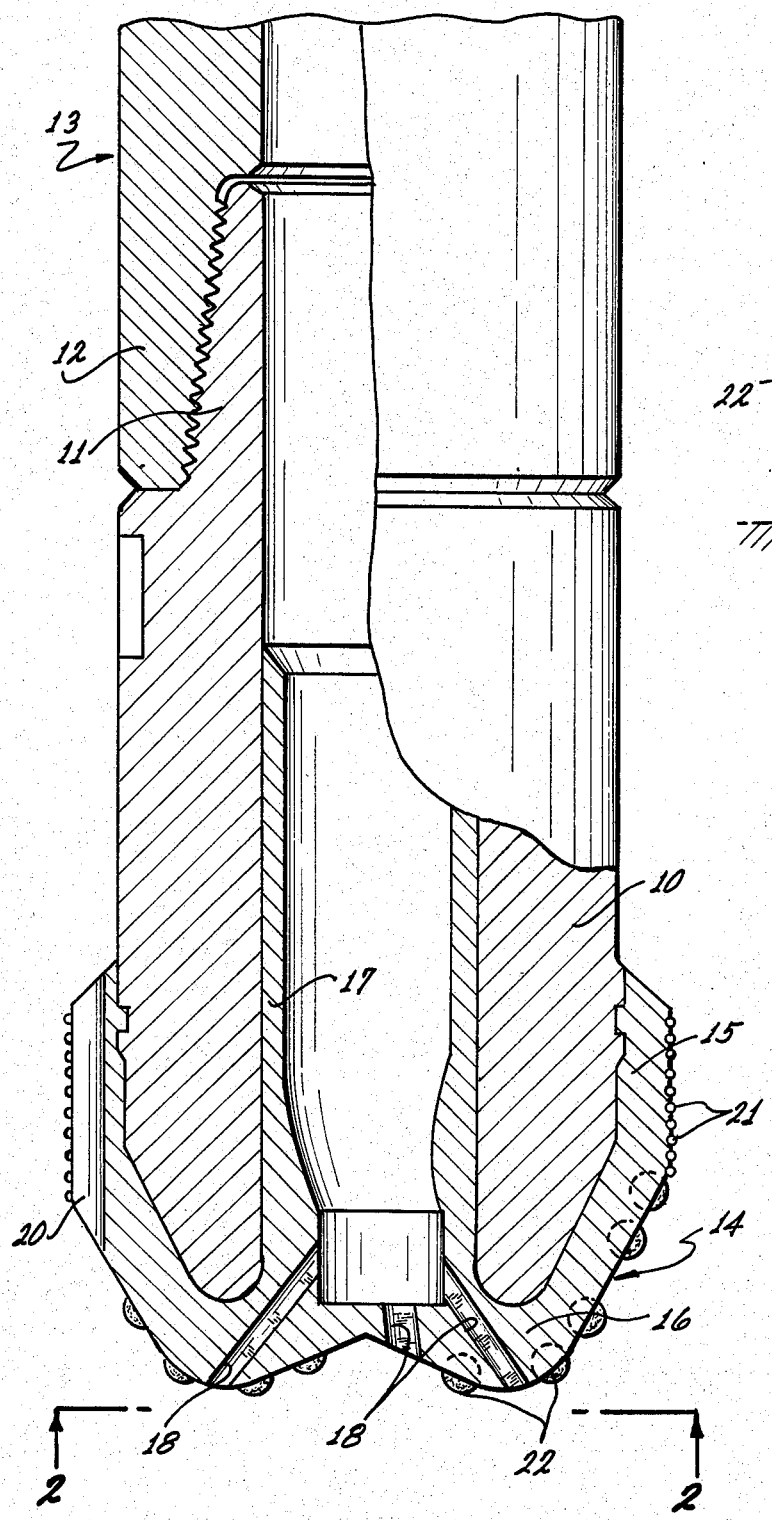
FIG. 1 is a view partly in elevation and partly in section of an earth-boring bit according to our invention.
Figure 3:
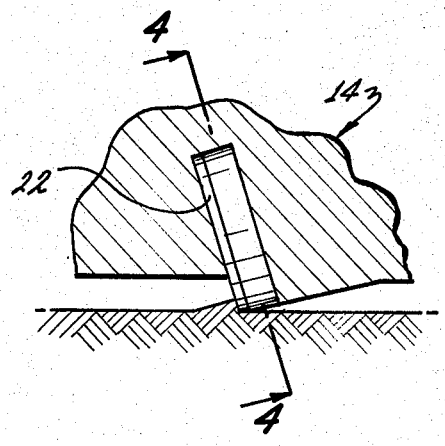
FIG. 3 is an enlarged fragmentary detail of one of the bit cutters mounted in the matrix of the bit.
Figure 4:
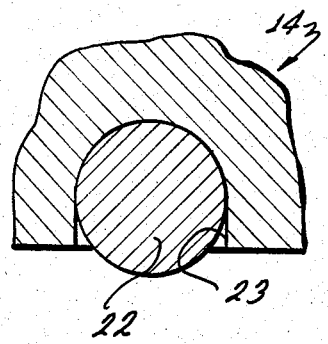
FIG. 4 is a section taken along the line 4—4 on FIG. 3.

The invention is illustrated in the drawings in conjunction with polycrystalline diamond compact drill bits disclosed in U.S. Pat. No. 4,244,432. As shown in FIG. 1, the drill bit includes a tubular steel shank 10 having an upper pin 11 threadedly secured to a companion box 12 forming the lower end of a drill string 13. A matrix crown of hard material 14, such as metal bonded tungsten carbide, has an upper stabilizer section 15 which merges into a face portion 16 extending across the tubular shank, which is integral with an inner portion 17 disposed within the tubular shank. Fluid pumped downwardly through the drill string and into the tubular shank can flow into the inner matrix portion 17, discharging through a plurality of nozzles or orifices 18 into the bottom of the bore hole, for the purpose of carrying the cuttings in a lateral outward direction across the face of the bit, and upwardly through a plurality of spaced vertical passages 19 in the stablizer section into the annulus surrounding the tubular shank and the drill string for conveyance to the top of the bore hole. A number of the fluid passages are of an enlarged size to function as junk slots 20 through which upward flow of the drilling fluid and cuttings can occur more readily. Diamonds 21 are enbedded in the stablizer 15 to reduce wear on the latter.

Compact cutters 22, such as disclosed in U.S. Pat. No. 4,244,432, are disposed in sockets 23 preformed in the matrix 14 that may be preferably arranged in a spiral pattern, such that they collectively cover substantially the entire area of the bottom of the bore hole in performing the cutting action. The drilling fluid flows downwardly through the drilling string into the inner portion 17 of the matrix bit crown, such fluid passing through nozzles 18 formed integrally in the matrix and discharging from the face of the bit against the bottom of the hole. Each nozzle 18 is rectangular in cross-section and is oriented with the long axis or side 24 disposed in the tangential direction, which causes the fluid discharging from each nozzle to sweep more broadly across the face of the bit and the cuttings toward the gauge portion of the bit, cleaning and cooling the cutters and sweeping outwardly across the bottom of the hole to clean the latter of cuttings, the cuttings and fluid then flowing upwardly around the stablizer portion 15 of the bit and through the vertical passages 18 and the junk slots 20 for continued upward movement around the drill pipe string to the top of the bore hole.

FIGS. 5*a* and 5*b* illustrate a round nozzle 30 and a corresponding rectangular nozzle 31 in which the pressure drop through both nozzles is substantially the same. It is to be noted that a large particle 32 plugs the round nozzle 30 (FIG. 5*a*), the same size and shaped particle 32 being capable of passing through the rectangular nozzle 31 (FIG. 5*b*).

FIG. 9 discloses a bottom plan view like FIG. 2 of a polycrystalline diamond compact bit A embodying five round nozzles 35 of equal area, whereas FIG. 10 discloses the same bit B with rectangular nozzles 36 shaped to provide substantially the same pressure drop in the fluid passing through each nozzle 35 as the bit embodying the round nozzles. A slight variant C (not shown) from the bit disclosed in FIG. 10, have the rectangular nozzles, is one in which such rectangular nozzles are located and oriented in the same manner as the bit in FIG. 10, the only difference residing in the rectangular nozzle 36 in the center of the bit being larger in its base and height dimensions.

The three polycrystalline diamond compact drill bits A, B, and C were built to specifications that were identical. All were $8\frac{3}{4}''$ diameter matrix body bits with 48 cutters arranged in the same reverse spiral pattern, all three bits having 5 nozzles and the same relative position in the bit. The nozzles were asymmetrical about the center of the bit to prevent a hydraulic trap in the bit center.

FIG. 11 is a graph showing the pressure drop across each of the three bits A, B and C. Bit A had an equivalent total flow (EFA) of 0.45, bit B an EFA of 0.41, and bit C of EFA of 0.41. The pressure drop for all three bits are presented in this graph with ten pounds per gallon mud being pumped through the bit nozzles. The graph shown in FIG. 12 shows the actual penetration rates of the three bits operating at 100 RPM in soft shale with the weight of 8,000 pounds imposed on the bit while operating at a depth of about 8,000 feet. Penetration rate bit A (round nozzles) was about $6\frac{1}{2}$ feet per hour, with a mud volume of 250 gallons per minute, this penetration rate increasing slightly as the volume of drilling mud per minute increased. As compared with bit A, bit B and bit C achieved a penetration rate of about 7 feet per hour with 250 gallons of mud per minute being pumped through each bit. This penetration rate of bits B and C increased to about 14 feet per hour with a volume of drilling mud increased to about 450 gallons per minute, as compared to a rate of about 7 feet per hour for bit A. In other words, the penetration rates of bits B and C almost doubled over the penetration rate of bit A upon increase of the drilling mud volume to 450 gallons per minutes.

We claim:

1. In a bit for drilling earth formations in which the bit includes a metallic shank having a fluid passage, one end of said shank being coated with a hard matrix material bonded to said end and forming a face of said bit, said hard matrix material having a wear resistance greater than that of said metallic shank, a plurality of polycrystalline diamond compact cutters mounted in sockets provided in said matrix and arranged such that the cutters collectively cover substantially the entire area of the bottom of a bore hole in a drilling operation, wherein said cutters include a supporting member and a polycrystalline cutting member so mounted in said matrix that a portion of said support member is beneath said matrix and at least a portion of said polycrystalline cutting member extends beyond the face of said matrix, and wherein said cutters operate to cut by shearing action to produce shavings which must be removed from the region between said face of said matrix and the opposed surface of the formation being cut, the improvement comprising a plurality of nozzles in said matrix face each communicating with said fluid passage for flow of fluid through said nozzles across the face of said matrix, each said nozzle comprising an orifice having a rectangular cross section normal to the axis of said orifice, said rectangular orifices including a height longer than the base thereof and being oriented with the height side extending in a tangential direction to cause the fluid flowing from each nozzle to sweep broadly across the face of the bit, and each of said nozzles being in the face of said bit such that the flow from each nozzle is across the face of said bit and the cutting member of the cutters mounted on said face.

2. A bit as set forth in claim 1 wherein each of said orifices comprises said hard material.

3. A bit as set forth in claim 1 wherein each of said orifices is integral with said hard material.

4. A bit as set forth in claim 1 wherein each orofice of rectangular shape has a base-to-height ratio of from about 1 to 1 to 1 to 2.5.

5. A bit as defined in claims 1, 2, 3 or 4 wherein said rectangular orifices are oriented with the height extending in a tangential direction.

* * * * *